United States Patent [19]

Watanabe et al.

[11] 4,347,413

[45] Aug. 31, 1982

[54] ELECTRODES OF VACUUM CIRCUIT BREAKER

[75] Inventors: Ryuji Watanabe, Tokaimura; Keiichi Kuniya, Hitachi, both of Japan

[73] Assignee: Hitachi, Ltd., Tokyo, Japan

[21] Appl. No.: 62,117

[22] Filed: Jul. 30, 1979

[30] Foreign Application Priority Data

Jul. 28, 1978 [JP] Japan ..... 53/91475

[51] Int. Cl.[3] ..... H01H 33/66

[52] U.S. Cl. ..... 200/144 B; 200/262; 200/266

[58] Field of Search ..... 200/144 B, 266, 262

[56] References Cited

U.S. PATENT DOCUMENTS

| | | | |
|---|---|---|---|
| 3,014,110 | 12/1961 | Cobine | 200/144 B |
| 3,502,465 | 3/1970 | Nakajima et al. | 200/144 B |
| 3,551,622 | 12/1970 | Takeuchi et al. | 200/144 B |
| 3,783,213 | 1/1974 | Amoth et al. | 200/144 B |
| 4,091,248 | 5/1978 | Arakawa et al. | 200/144 B |

FOREIGN PATENT DOCUMENTS

| | | | |
|---|---|---|---|
| 1074120 | 1/1960 | Fed. Rep. of Germany | 200/144 B |
| 1194674 | 6/1970 | United Kingdom | 200/144 B |

*Primary Examiner*—Robert S. Macon

*Attorney, Agent, or Firm*—Craig and Antonelli

[57] ABSTRACT

An electrode of a vacuum circuit breaker, having a high dielectric strength, large breaking current and superior non-welding characteristic. The electrode is made of a cast alloy comprising copper, 20 wt% or less of rare earth metal such as lanthanum, cerium or an alloy of either one of these rare earth metal with another rare earth metal, 10 wt% or less of a metal such as lead and bismuth having a lower melting point and a higher vapor pressure than copper, and 0.1 to 30 wt% of a metal of iron group. A part of the rare earth metal and a part of the metal having the lower melting point and higher vapor pressure than copper are crystallized in the grain boundary and in the grains of copper.

15 Claims, 4 Drawing Figures

× 100

ELECTRODES OF VACUUM CIRCUIT BREAKER

BACKGROUND OF THE INVENTION

The present invention relates to electrodes of a vacuum circuit breaker and, more particularly, to electrodes of a vacuum circuit breaker having a high dielectric strength, large breaking current and a superior non-welding characteristic.

Electrodes of a circuit breaker has to have various electric and physical properties such as (1) high dielectric strength, (2) superior non-welding characteristic, (3) large breaking current, (4) small chopping current, (5) small gaseous content and so forth, among which the properties (1) to (3) are important factors which affects the breaking capacity of the vacuum circuit breaker.

The aforementioned properties can be improved to some extent by improving the electrode material or technic of production of the electrodes. It is, however, considerably difficult to simultaneously achieve the improvements in both of the dielectric strength and the breaking current characteristic.

Hitherto, an electrode having a high dielectric strength has been known, which is composed of an alloy comprising an iron group metal such as iron (Fe) or cobalt (Co) and remainder of copper (Cu). This electrode unfortunately has only a small breaking current, because it possesses a conductivity which is not greater than 30 IACS%.

Also, as an electrode having a large breaking current and superior non-welding characteristic, an electrode has been known which is composed of an alloy comprising a metal having a low melting point and high vapor pressure, as well as extremely small solid solubility to copper, e.g. lead (Pb), bismuth (Bi) or the like and remainder of copper (Cu). This electrode, however, exhibits an impractically low dielectric strength.

An electrode which is composed of an alloy comprising copper containing both of the aforementioned iron group metal and a metal of low melting point and high vapor pressure such as Pb and Bi has been known also. This electrode exhibits unexpectedly a breaking current the level of which is as low as that of the electrode which is composed of an alloy comprising the iron group metal and the Cu.

An electrode made of an alloy comprising Cu and a rare earth metal has been known as an electrode which exhibits a property intermediate of those of the electrode having the high dielectric strength and the electrode having the large breaking current. Some of the electrodes of this kind is formed as a compound of Cu and the rare earth metal. This electrode, however, is poor in the non-welding characteristic which is another essential requisite for the vacuum circuit breaker. Namely, the electrodes of this material are liable to be welded to each other by a certain breaking current.

Meanwhile, a current tendency of enlargement of the capacity of incoming facilities and substations gives a rise to a demand for an electrode material which possesses all of the essential requisites (1) to (3), i.e. high dielectric strength, large breaking current and superior non-welding characteristic.

The fourth requisite, i.e. the small chopping current, can be achieved by adding various metals to the matrix material. However, recently, the problem concerning the chopping current is becoming less severe, because of various measures taken in the electric circuit for suppressing the extraordinary voltage which would cause a large chopping current. The fifth requisite, i.e. small gaseous content, can be achieved by making an ingot of the electrode material in a vacuum atmosphere making use of de-gassing material or the like measure.

SUMMARY OF THE INVENTION

OBJECT OF THE INVENTION

It is, therefore, an object of the invention to provide electrodes of a vacuum circuit breaker having a high dielectric strength, large breaking current and a superior non-welding characteristic.

It is another object of the invention to provide electrodes of a vacuum circuit breaker having a dielectric strength and breaking current intermediate of those exhibited by the conventional electrode having high dielectric strength and the conventional electrode having large breaking current, and also a non-welding characteristic equivalent to that exhibited by the conventional electrode composed of an alloy comprising Cu and a metal such as Pb, Bi or the like having a low melting point and a high vapor pressure.

It is still another object of the invention to provide electrodes of a vacuum circuit breaker having a dielectric strength equivalent to or higher than that of the aforementioned conventional electrode having a high dielectric strength, and having a breaking current and non-welding characteristic and breaking current which are intermediate of those exhibited by the above-mentioned conventional electrode and the aforementioned conventional electrode composed of the alloy comprising Cu and Pb, Bi or the like.

STATEMENT OF INVENTION

To these ends, the invention provides an electrode of a circuit breaker, which is basically made of a cast alloy comprising Cu, 20 weight percent or less of at least one rare earth metal, and 10 weight percent or less of a metal having a lower melting point and higher vapor pressure than Cu, wherein a part of the rare earth metal and a part of the metal having the lower melting point and higher vapor pressure than Cu are crystallized in the grain boundary and grains of Cu.

The electrode of vacuum circuit breaker in accordance with the invention can further include 0.1 to 30 weight percent of at least one iron group metal.

Rare earth metals such as La, Ce or a mixture alloy thereof with another rare earth metal, more practically Mischmetal, can be used as the rare earth metal used in the invention. Usually, the rare earth metal content exceeds the solid solubility limit to Cu but not greater than 20 weight percent.

Also, at least one metal selected from a group consisting of Pb, Bi, thallium (Tl), Indium (In), selenium (Se), cadmium (Cd) and tellurium (Te) is used as the metal having lower melting point and higher vapor pressure than Cu. This metal is contained by an amount exceeding its solid solubility limit but not greater than 10 weight percent.

The aforementioned rare earth metals and metals of low melting point and high vapor pressure exhibit small solid solubility to Cu when they are in the solid state. Therefore, no abrupt reduction of conductivity is caused by the addition of these metals to Cu. In fact, a test conducted with a test piece showed a conductivity which amounts to 70 to 80% of that of pure Cu. Also, a corroboration for the possibility of increase of breaking current was obtained as a result of this test.

The electrode of the invention containing rare earth metals and metals having lower melting point and higher vapor pressure than Cu exhibits a higher dielectric strength than the conventional electrode made of an alloy comprising Cu and a metal having lower melting point and higher vapor pressure than Cu. The level of the dielectric strength of the electrode of the invention is substantially equal to that exhibited by the electrode composed of the alloy comprising Cu and a rare earth metal.

The high dielectric strength which is obtained in spite of addition of metal having lower melting point and higher vapor pressure than Cu may be attributed to the following reason. Namely, the rare earth metal and a part of metal such as Pb and Bi form an intermetallic compound which itself has a high dielectric strength to effectively compensate for the reduction of dielectric strength of the alloy.

The content of the rare earth metal such as La, Ce or the like should be selected to be greater than the solid solution limit (about 0.1% or more) but not greater than 20 weight percent. A rare earth metal content exceeding 20 weight percent will impair the anti-oxidation property of the electrode to permit an oxidation of the electrode during the use. Also, a rare earth metal content less than the solid solubility limit will be insufficient to form the intermetallic compound of such a rare earth metal with Cu or the metal having lower melting point and higher vapor pressure than Cu to incur a degradation of the dielectric strength. Thus, the rare earth metal content is preferably selected to fall within the range of between 1 and 5 weight percent.

Also, the amount of addition of the metals having low melting point, e.g. Pb or Bi, should be selected to be greater than the solid solubility limit (about 0.01% or more) but not greater than 10 weight percent. If the content of this metal is smaller than the solid solubility limit, a large force will be required for separating the electrodes when they are happened to be welded to each other. To the contrary, a content exceeding 10 weight percent will degrade the dielectric strength. Thus, the content of the metal of low melting point is preferably selected to fall within the region of between 0.1 and 7 weight percent.

The electrode of the invention can be fabricated by working a cast material into the shape of an electrode. The cast material may be subjected to a granulation or spheroidizing treatment before it is worked into the shape of an electrode.

In an ordinary casting with a mold, components such as La or Ce and Pb or Bi merely exist in elongated patterns along the grain boundary of Cu. However, by the granulation or spheroidizing, these components are granulated and finely distributed to further improve the dielectric strength and to stabilize the chopping current characteristic, as well as non-welding characteristic.

The granulation or spheroidizing treatment is preferably carried out by reheating a cast structure, which has been preferably rapidly cooled after the casting, to a temperature higher than the recrystallization temperature, preferably to a temperature immediately below the melting point.

By this spheroidizing treatment, the Cu dendrite structure formed as a result of the casting is collapsed to permit a uniform dispersion of Pb, Bi, La, Ce and the like in and out of the Cu grains. The components thus uniformly dispersed can hardly be evaporated or exuded. This feature possesses various advantages. Firstly, these metal components are prevented from being undesirably lost by the heat during a heat treatment in the assembling process, e.g. soldering to the electrode holder, or by the heat generated at the time of breaking of the circuit, Secondly, the control of ratio of contents of the alloy is facilitated. Thirdly, the deterioration of performance is fairly avoided.

In order to more finely granulate these metal components and to distribute the granulated metals more uniformly and finely, it is recommended to effect the heat treatment on the alloy for recrystallization and spheroidizing, after imparting a forging strain to the alloy.

Clearly, the fluctuation of dielectric strength and non-welding characteristic is suppressed if the casting is made under such a condition as to provide a fine cast structure. From this point of view, water-cooled casting method and pressure casting method are suitably adopted.

It is possible to further increase the dielectric strength by adding at least one iron group metal to the alloy comprising Cu, rare earth metal and a metal having a lower melting point and higher vapor pressure than Cu, although non-welding characteristic is somewhat reduced by the addition of the iron group metal. The dielectric strength of this alloy is equivalent to or greater than that of the aforementioned electrode made of an alloy of Cu and an iron group metal.

The iron group metal as used in the invention is the one selected from the group consisting of Fe, Co and nickel (Ni), and its content is selected preferably to fall within the range of between 0.1 and 30 weight percent. A content smaller than 0.1% by weight is too short to provide an appreciable effect of increase of the dielectric strength while a content exceeding 30 weight percent will inconveniently decrease the breaking current.

DESCRIPTION OF PREFERRED EMBODIMENTS

Example 1

Oxygen fre copper (OFC), 99.9% La and Pb treated by degassing process were used as the raw material of the Cu-3wt %La-7.0wt %Pb alloy. The ingot making and casting were made in the following manner. The total melting amount was selected to be 20 kg. At first, Cu and La were melted in a vacuum atmosphere of pressure of 1 to $5\times10^{-5}$ Torr by means of a high frequency heating. After confirming the molten state of these metals, Ar gas of a high purity was introduced into the vacuum atmosphere to a pressure of 10 to 20 Torr and then Pb was added to avoid an evaporation loss. Thereafter, the metals were casted at a temperature of 1200° to 1300° C. into a mold of 45 mm dia. and 100 mm height. It was confirmed that the expected ingot structure is fairly obtainable by the above described process.

Figure 1:
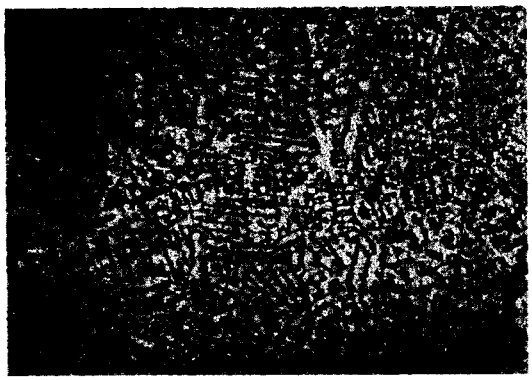
FIG. 1 is a microscopic photograph of the structure of a Cu-3wt %La-0.7wt %Pb alloy which is a typical example of the electrode material in accordance with the invention.

FIG. 1 shows a microscopic photograph (magnification 100) of the structure as picked up from a central portion of the ingot thus formed.

It will be seen that both of Pb and La are finely distributed along the gaps between Cu dendrites. Electrode materials of 20 mm dia. were cut out from this ingot and were subjected to a breaking test. After a breaking of AC 300 A, an impulse voltage was applied at 5 KV step and the discharge voltages were measured. The electrode gap was set at 2.5 mm. As a result, a mean dielectric strength of 45 KV was observed. Also, the chopping current was measured under a voltage of 6.3 KV and at a current of 4 A. The mean current of 8 A was recorded as the result of the measurement. This mean chopping current is much lower than the chopping current of oxygen-free copper which is usually 10 to 14 A. Also, a conductivity of not smaller than 70 IACS % was observed.

EXAMPLE 2

Electrodes of Cu-La-0.7wt %Pb alloy was prepared in the same way as the first example. Properties such as conductivity (IACS %), dielectric strength, chopping current characteristics and so forth were measured and compared with those of conventional Cu-Co-Pb alloy and Cu-Pb alloy. In these three alloys, the contents of underlined components were varied with respect to Cu.

Figure 2:
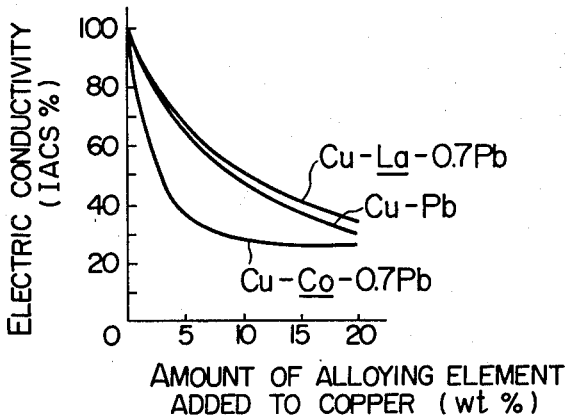
FIG. 2 shows the conductivity (IACS %) of a Cu-La-Pb alloy electrode material in accordance with the invention, in comparison with those of conventional Cu-Co and Cu-Pb alloy materials.

FIG. 2 shows the conductivities of these alloys. An alloy such as Cu-Co-Pb alloy containing a component which has a solid solubility to copper, e.g. Co, however it may be small, exhibits a drastic reduction of the conductivity. However, the alloys such as Cu-Pb or the Cu-La-Pb alloy of the invention having component almost insoluble to copper show a comparatively gentle reduction of the conductivity.

Figure 3:
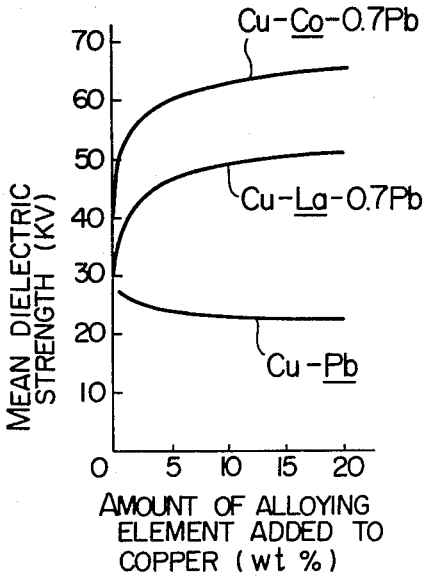
FIG. 3 shows the mean dielectric strength (KV) of the Cu-La-Pb alloy of the invention in comparison with those of the Cu-Co and Cu-Pb alloys.

FIG. 3 shows the dielectric strengths of these three alloys. The test for measuring the dielectric strength was made with the same electrode shape and electrode gap as those in Example 1. The Cu-La-Pb alloy of the invention showed a dielectric strength which falls intermediate the dielectric strengths of the Cu-Co-Pb alloy and the Cu-Pb alloy.

It will be seen that the previously described increase of the dielectric strength is fairly achieved by the invention.

The reason why the dielectric strength of the Cu-Pb alloy is not so changed by the increment of Pb content has not been clarified yet. It is, however, understood that the Cu-Pb alloy has a practical limit in the increase of the dielectric strength. It is remarkable that the Cu-La-Pb alloy of the invention exhibits a dielectric strength which is twice or more as high as that of the Cu-Pb alloy, while maintaining the conductivity equivalent to or higher than that of the latter.

Figure 4:
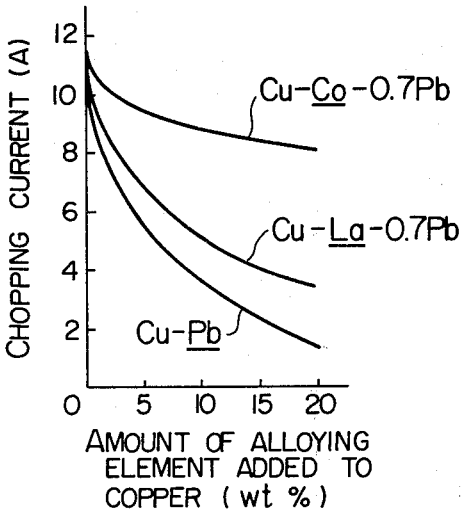
FIG. 4 shows the mean chopping current (A) of the Cu-La-Pb alloy of the invention in comparison with those of Cu-Co and Cu-Pb alloys.

FIG. 4 shows chopping current characteristics of these three alloys. It has been known that the chopping current of Cu-Pb alloy is gradually decreased as the Pb content is increased. The Cu-La-Pb alloy of the invention shows a considerable reduction of the chopping current, although the effect of reduction is not so remarkable as that provided by the addition of Pb.

EXAMPLE 3

An ingot of Cu-3wt %La-0.3wt %PbBi (PbBi has a composition represented by Pb-40wt %Bi) was made in the same manner as Example 1. Test pieces having the shape of the electrode were cut out from this ingot and subjected to a test for examining the dielectric strength, chopping current and also the non-welding characteristic. As a result of this test, it was confirmed that the electrodes of the invention can operate without substantial problem, even in comparison with the conventional electrodes made of Cu-20wt %Co-0.5wt %PbBi alloy or Cu-0.7wt %Pb alloy, and that the non-welding characteristic is considerably improved by the addition of a metal such as Pb or Bi having a low melting point and high vapor pressure to the Cu-La system.

EXAMPLE 4

Electrodes were made from the material of Example 3. These electrodes were subjected to a spheroidizing treatment which is conducted in a vacuum atmosphere at a temperature of 900° C. for one hour. As a result, the components such as La, Pb, Bi and so forth were evenly dispersed in and out of Cu grains. The undesirable exudation and evaporation of these elements were not observed even when these electrodes were heated up to 850° to 900° C. at which the electrodes are soldered to the electrode holders. Thus, it was confirmed that the electrode of the invention can be assembled without substantial problem.

EXAMPLE 5

Electrodes having compositions shown in Table 1 were made by the same process as Example 1. Then, dielectric strength and chopping current were measured in the same manner as the Example 1. The result of these measurements were also shown in Table 1. The electrodes under the item Nos. 6 to 11 are the electrodes of the invention.

TABLE 1

| | Alloy composition (wt %) | Conductivity (%) | Mean dielectric strength (kV) | Mean chopping current (A) | Non-welding characteristic |
|---|---|---|---|---|---|
| 1 | Cu—0.7Pb | 96 | 27–30 | 8.5 | |
| 2 | Cu—5Co | 29 | 60–70 | 8 | X |
| 3 | Cu—20Co—5BiPb | 27 | 52–62 | 3.8 | ◎ |
| 4 | Cu—3La | 77 | 40–45 | 6.2 | X |
| 5 | Cu—3Ce | 78 | 45–60 | 8.2 | X |
| 6 | Cu—1Ce—3Pb | 80.8 | 40–50 | 5.4 | ◎ |
| 7 | Cu—2Ce—3Pb | 73.2 | 45–62 | 5.9 | ◎ |
| 8 | Cu—1La—3Bi | 83.5 | 30–45 | 4.0 | ◎ |
| 9 | Cu—2Ce—5Co—6Pb | 37 | 65–76 | 5.5 | ◎ |
| 10 | Cu—3La—3Fe—0.7Pb | 40 | 60–70 | 8.0 | O |
| 11 | Cu—3Fe—2Mischmetal —0.7Pb | 42 | 65–72 | 6.9 | O |

The electrode of the invention made of an alloy comprising Cu, a rare earth metal and a metal having a low melting point and high vapor pressure exhibits superior non-welding characteristic and chopping current characteristics, even in comparison with the electrode of the alloy comprising Cu and a rare earth metal which exhibits the highest dielectric strength and most superior breaking current characteristic among the conventional electrodes. In addition, this alloy of the invention can compare with the above-mentioned conventional electrode also in the aspects of dielectric strength and conductivity.

It is also clear that the electrode of the invention made of an alloy comprising Cu, rare earth metal and a metal such as Pb, Bi having low melting point and high vapor pressure can compare with the conventional electrode No. 2 (in Table 1) which is known as the electrode having high dielectric strength.

As has been described, according to the invention, it is possible to obtain an electrode of vacuum circuit breaker, which simultaneously satisfies the requisites of a high dielectric strength, good breaking current characteristic and a superior non-welding characteristic. The invention, therefore, well meets the current tendency of enlargement of capacities of incoming equipments and substations.

What is claimed is:

1. An electrode for a vacuum circuit breaker made of a cast alloy consisting essentially of copper, about 0.1 to 20wt % of a rare earth metal and about 0.01 to 10wt % of a metal having a lower melting point and a higher vapor pressure than copper, wherein a part of said rare earth metal and a part of said metal having lower melting point and higher vapor pressure than copper are crystallized in the grain boundary or in the grains of copper.

2. An electrode of a vacuum circuit breaker as claimed in claim 1, wherein said rare earth metal is one or more of metals selected from a group consisting of lanthanum, cerium and a mixture alloy of at least one of these metals and another rare earth metal.

3. An electrode of a vacuum circuit breaker as claimed in claim 1, wherein said metal having lower melting point and higher vapor pressure than Cu is constituted by at least one selected from lead, bismuth and their alloy.

4. An electrode of a vacuum circuit breaker as claimed in claim 2, wherein the content of said rare earth metal is 1 to 5 wt %.

5. An electrode of a vacuum circuit breaker as claimed in claim 3, wherein the content of at least one of said lead, bismuth and their alloys is 0.1 to 7 wt %.

6. An electrode of a vacuum circuit breaker as claimed in claim 1, wherein a part of said rare earth metal and a part of said metal having a lower melting point and a higher vapor pressure than copper are crystallized in a granular or spheroidized form.

7. An electrode of a vacuum circuit breaker as claimed in claim 1, wherein said cast alloy has been casted by water-cooled casting method or pressure casting method.

8. An electrode of a vacuum circuit breaker made of a cast alloy consisting essentially of copper, about 0.1 to 20 wt % of a rare earth metal, about 0.01 to 10 wt % of a metal having a lower melting point and a higher vapor pressure than copper, and 0.1 to 30 wt % of a metal of iron group, wherein a part of said rare earth metal and a part of said metal having a lower melting point and higher vapor pressure than copper are crystallized in the grain boundary and in the grains of copper.

9. An electrode of a vacuum circuit breaker as claimed in claim 8, wherein said metal of iron group is at least one of iron and cobalt.

10. An electrode of a vacuum circuit breaker as claimed in claim 9, wherein said cast alloy contains at least one of iron and cobalt by an amount in excess of its solid solubility limit.

11. An electrode of a vacuum circuit breaker as claimed in claim 8, wherein said rare earth metal is constituted by at least one of lanthanum, cerium and mixture alloys of at least one of these metals with another rare earth metal.

12. An electrode of a vacuum circuit breaker as claimed in claim 8, wherein said metal having a lower melting point and a higher vapor pressure than copper is constituted by at least one of lead, bismuth and their alloys.

13. An electrode of a vacuum circuit breaker as in claim 1 or 8, wherein said metal having a lower melting point and a higher vapor pressure than copper is at least one metal selected from the group consisting of lead, bismuth, thallium, indium, selenium, cadmium and tellurium.

14. An electrode of a vacuum circuit breaker as in claim 1, wherein said cast alloy consists of copper, a rare earth metal, and a metal having a lower melting point and a higher vapor pressure than copper.

15. An electrode of a vacuum circuit breaker as in claim 8, wherein said cast alloy consists of copper, a rare earth metal, a metal having a lower melting point and a higher vapor pressure than copper, and a metal of iron group.

* * * * *